US005625254A

United States Patent [19]

Hamada

[11] Patent Number: 5,625,254

[45] Date of Patent: Apr. 29, 1997

[54] FLUORESCENT CHARACTER DISPLAY TUBE WITH VIBRATION PREVENTION STRUCTURE

[75] Inventor: Shinichi Hamada, Kagoshima, Japan

[73] Assignee: NEC Corporation, Tokyo, Japan

[21] Appl. No.: 491,216

[22] Filed: Jun. 16, 1995

[30] Foreign Application Priority Data

Jun. 21, 1994 [JP] Japan ..... 6-138843

[51] Int. Cl.[6] ..... H01J 63/06

[52] U.S. Cl. ..... 313/493; 313/514; 313/495; 313/269

[58] Field of Search ..... 313/513, 514, 313/515, 495, 496, 497, 493, 271, 272, 238, 269; 156/67

[56] References Cited

U.S. PATENT DOCUMENTS 3,921,026 11/1975 Konishi ..... 313/513
4,719,152 1/1988 Ohta ..... 313/503
4,841,194 6/1989 Kishino ..... 313/497

FOREIGN PATENT DOCUMENTS 60-112065 7/1985 Japan .
62-1357 1/1987 Japan .

*Primary Examiner*—Sandra L. O'Shea
*Assistant Examiner*—Vip Patel
*Attorney, Agent, or Firm*—Young & Thompson

[57] ABSTRACT

A fluorescent character display tube has an anode base plate, a frame, a filament supporting member, and a fixing layer. The frame is provided above the anode base plate and the filament supporting member is welded on the frame. The fixing layer is provided between the frame and the anode base plate such that the frame is securely and air-tightly fixed to the anode base plate. The fixing layer may be a low melting point glass layer or a high heat-resistant resin. The high heat-resistant resin may be polyimide. The arrangement enables to reducing the vibration of the frame thereby reducing the noise.

6 Claims, 2 Drawing Sheets

FLUORESCENT CHARACTER DISPLAY TUBE WITH VIBRATION PREVENTION STRUCTURE

BACKGROUND OF THE INVENTION (1) Field of the Invention

The present invention relates to a fluorescent character display tube, and more particularly to a fluorescent character display tube in which the noise to occur at a frame portion of the tube is reduced.

(2) Description of the Related Art

A conventional fluorescent character display tube is shown by a plan view in FIG. 1 and a sectional view taken along line 2—2 of FIG. 1 is shown in FIG. 2. In FIG. 1, reference numeral 7 denotes a display pattern, 8 an anode terminal, 9 lead pin, and 13 a grid.

For purposes of maintaining a vacuum state, an anode base plate 5 and a cover glass (not shown) are assembled, and the resulting structure is sealed by a low melting point glass 1 applied on a spacer glass 6 as shown in FIG. 2. The spacer glass 6 and the anode base plate 5 sandwich a frame 2 on which a filament supporting member 3 is welded. In this configuration, there remains an airspace 14, though such an airspace is very slight, between the anode base plate 5 and the frame 2, and this airspace has presented difficulties in making the complete sealing. For this reason, as explained more fully later, the problem has often occurred wherein the frame and the filament supporting member vibrate resulting in noise.

Japanese Utility Model Application Kokai Publication No. Sho 60-112065 discloses a technology whereby a vibration prevention member is fixed to a frame portion. This technology is intended to prevent the noise from being produced from the display tube (especially from the frame portion). Also, Japanese Utility Model Application Kokai Publication Sho 62-1357 discloses a technology whereby a vibration prevention damper is provided at a filament portion. This technology is intended to prevent noise from occuring from the display tube (especially from the filament portion).

In the fluorescent character display tube, the filament supporting member vibrates in accordance with the filament driving frequency, and the resonance at the frame portion develops. When the vibration due to the resonance is transmitted through the frame out to the exterior, this becomes an unpleasant noise (the noise level being 30 dB to 60 dB). The use of the noise prevention member as disclosed in the Utility Model Application Kokai Publication No. Sho 60-112065 is effective for a certain one vibration frequency, but is not sufficiently effective in reducing noise levels for wider frequency ranges, and has suffered from an increase in the cost of materials and in the steps of manufacturing.

A further problem is that, when the tube assembly receives an external impact, the frame vibrates, the filament supporting member resonates and further the filament resonates. The filament that vibrates by the resonation may come into contact with the grid that is a control electrode, causing a material coated on the filament to be peeled off. The use of the filament vibration prevention technology disclosed in the Utility Model Application Kokai Publication No. Sho 62-2357 is not effective for the prevention of the peeling-off of the material coated on the filament since the contact of the filament onto the damper is unavoidable. The technology also suffers from an increase in the cost of materials and the steps of manufacturing, and from complicating the control electrode.

SUMMARY OF THE INVENTION

An object of the present invention, therefore, is to overcome the problems existing in the prior art and to provide a fluorescent character display tube wherein the vibration of the frame is effectively reduced.

According to one aspect of the invention, there is provided a fluorescent character display tube comprising:

an anode base plate;

a frame provided above the anode base plate;

a filament supporting member welded on the frame; and a fixing layer provided between the frame and the anode base plate such that the frame is securely fixed to the anode base plate.

According to the invention, since the frame to which the filament supporting member is securely adhered on and welded to the anode base plate, the vibration of the frame is positively suppressed. That is, although the frame tends to resonate due to the vibration of the filament supporting member generated in accordance with the filament driving frequency, with the vibration being transmitted out and being heard as noise, the arrangement according to the invention is effective in lowering the noise level by positively suppressing the vibration that results in the occurrence of noise. Also, since the frame is fixed, the resonance of the frame caused not only internally but caused also by external impacts can be reduced, and the peeling-off of the material coated on the filament can be reduced. This is effective in preventing the occurrence of nonuniform display caused by the peeling-off of the material coated on the filament.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENTS OF THE INVENTION

Now, preferred embodiments of the invention are described with reference to the drawings.

Figure 1:
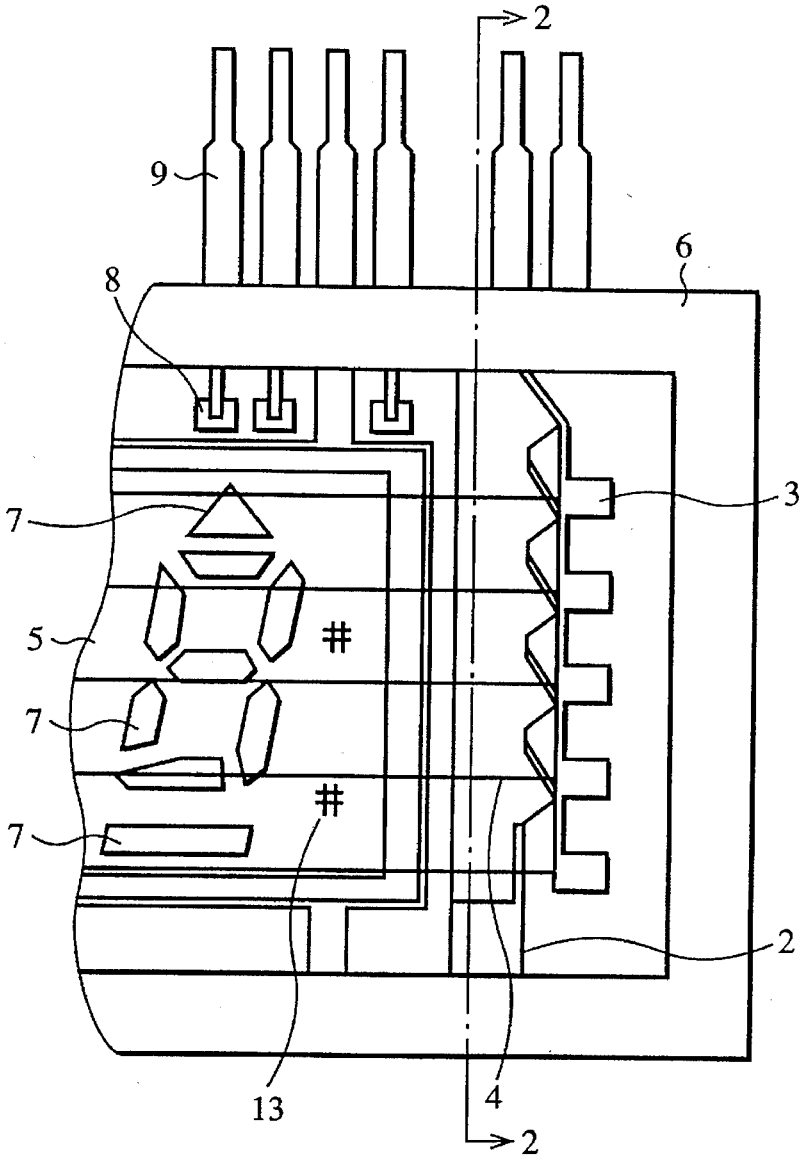
FIG.1 PRIOR ART
FIG. 1 is a plan view of an example of a conventional fluorescent character display tube.
Figure 2:
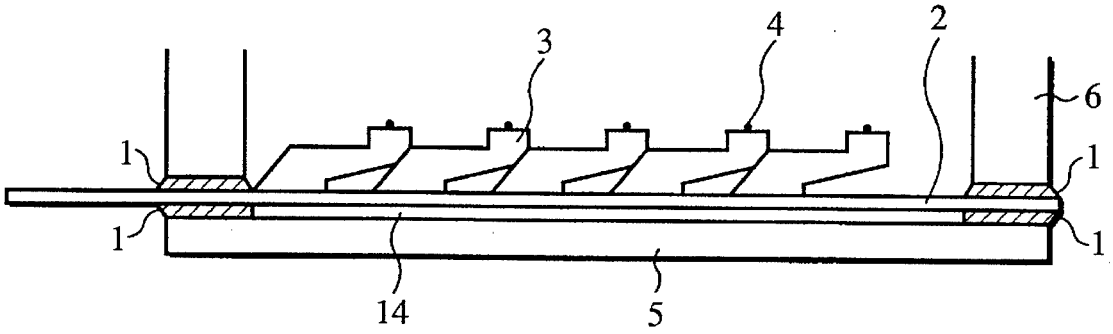
FIG.2 PRIOR ART
FIG. 2 is a sectional view of the display tube taken along line 2—2 of FIG. 1.
Figure 3:
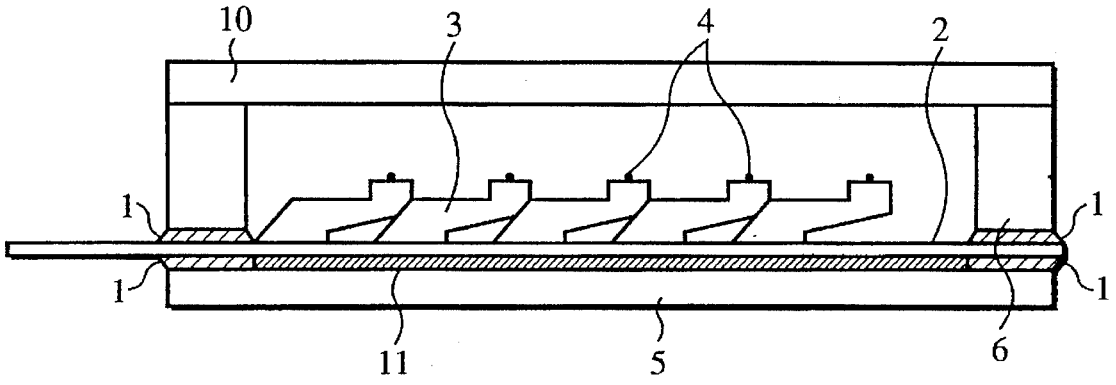
FIG. 3 is a sectional view of a fluorescent character display tube of a first embodiment according to the invention.

FIG. 3 shows, in a diagrammatic sectional view, a fluorescent character display tube of a first embodiment according to the invention. As shown therein, a filament 4 is welded onto a filament supporting member 3, and the filament supporting member 3 is welded on a frame 2. This frame 2, at each of its two side portions, is sandwiched between a spacer glass 6 of a cover glass 10 and an anode base plate 5, and is fixed by a low melting point glass 1 provided on each of upper and lower faces of the frame 2. Also, a low melting point glass 11 serving as a fixing layer is provided so as to extend between the two side portions and be sandwiched between the frame 2 and the anode base plate 5. Due to the low melting point glass 11, the frame 2 is securely and air-tightly fixed to the anode base plate 5. This low melting point glass 11 can be realized by printing so that there is no need to change the conventional manufacturing procedures.

With the arrangements according to the invention as above, the level of noise which was from 30 dB to 60 dB in the prior art has been improved to the level lower than 30 dB. This measurement was carried out in a noise proof room having a background noise level lower than 25 dB, with the testing structure being attached to the device actually used and with the noise meter being kept 10 mm away from the testing structure.

Figure 4:
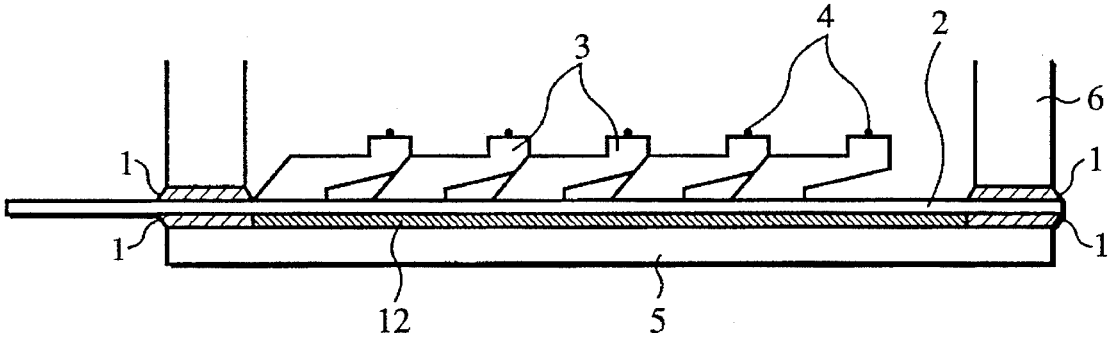
FIG. 4 is a sectional view of a fluorescent character display tube of a second embodiment according to the invention.

FIG. 4 shows, in a diagrammatic sectional view, a fluorescent character display tube of a second embodiment according to the invention. In this embodiment, the fixing layer for fixing the frame 2 to the anode base plate 5 is a polyimide layer 12 which is of high heat-resistant resin. The high heat-resistant resin is used because the manufacturing process includes steps in which the temperature used is of the order of 400° C. and it is necessary to use the high heat-resistant resin that can withstand the above temperature. This resin has been confirmed as having the same adhesion fixing effect and vibration prevention effect as those of the low melting point glass.

While the invention has been described in its preferred embodiments, it is to be understood that the words which have been used are words of description rather than limitation and that changes within the purview of the appended claims may be made without departing from the true scope and spirit of the invention.

What is claimed is:

1. In a fluorescent character display tube comprising an anode base plate; a frame spaced above said anode base plate, a filament-supporting member welded on said frame, and means sealingly interconnecting marginal portions of said base plate to said frame; the improvement comprising a fixing layer disposed between said frame and said anode base plate and securely fixing said frame to said anode base plate in central regions of said frame.

2. A fluorescent character display tube as claimed in claim 1, wherein said fixing layer extends between portions of said sealing means disposed along opposite marginal portions of said base plate.

3. A fluorescent character display tube as claimed in claim 1, wherein said fixing layer is a low melting point glass layer.

4. A fluorescent character display tube as claimed in claim 1, in which said fixing layer is a high heat resistant resin layer.

5. A fluorescent character display tube according to claim 4, in which said high heat resistant resin layer is a polyimide layer.

6. A fluorescent character display tube according to claim 5, in which said sealing means is a low melting point glass layer.

* * * * *